US007030829B1

(12) United States Patent
McLean

(10) Patent No.: US 7,030,829 B1
(45) Date of Patent: Apr. 18, 2006

(54) TRANSMISSION LINE CONDUCTOR FOR LOG-PERIODIC DIPOLE ARRAY

(75) Inventor: James S. McLean, Austin, TX (US)

(73) Assignee: TDK RF Solutions, Cedar Park, TX (US)

( * ) Notice: Subject to any disclaimer, the term of this patent is extended or adjusted under 35 U.S.C. 154(b) by 0 days.

(21) Appl. No.: 10/727,410

(22) Filed: Dec. 4, 2003

Related U.S. Application Data

(62) Division of application No. 10/022,759, filed on Dec. 13, 2001, now Pat. No. 6,677,912.

(51) Int. Cl.
*H01Q 11/10* (2006.01)

(52) U.S. Cl. ..... 343/792.5; 343/810; 174/70 A

(58) Field of Classification Search ..... 343/792.5, 343/810, 812, 815; 174/70 A, 102 R, 15.5, 174/125.1; H01Q 11/10
See application file for complete search history.

(56) References Cited

U.S. PATENT DOCUMENTS

| | | | | |
|---|---|---|---|---|
| 3,427,659 | A | 2/1969 | Finneburgh et al. | |
| 4,785,307 | A | 11/1988 | Kuo | |
| 4,881,907 | A | 11/1989 | Bergman et al. | |
| 4,922,058 | A | 5/1990 | Rodrigues | |
| 4,927,985 | A | 5/1990 | Iyer et al. | |
| 5,001,303 | A | 3/1991 | Coleman et al. | |
| 5,248,851 | A | 9/1993 | Chason et al. | |
| 5,886,672 | A | 3/1999 | Brune et al. | |
| 2003/0034931 | A1* | 2/2003 | Shepherd et al. | 343/792.5 |
| 2004/0145531 | A1* | 7/2004 | Godard et al. | 343/792.5 |

OTHER PUBLICATIONS

Sunol Sciences Corporation, JB Series, Broadband EMC Test Antennas, 30 MHz-5GHz, © 2003, 4 pages.
Sunol Sciences Corporation, Model LP1, Log-Periodic Antenna, 200 MHz-2GHz, © 2003, 2 pages.

* cited by examiner

*Primary Examiner*—Hoanganh Le
(74) *Attorney, Agent, or Firm*—Kevin L. Daffer; Daffer McDaniel, LLP

(57) ABSTRACT

A conductive member may include a conductor having a pair of opposed parallel surfaces and a cable guide arranged inside the conductor. In another embodiment, a conductive member may include a conductive bar having a pair of opposed parallel surfaces and a convex surface connecting respective first ends of the pair of opposed parallel surfaces to one another. An embodiment of a method for forming a conductive member includes forming a cable guide arranged inside a conductor having opposed parallel surfaces, where the cable guide is oriented in a direction substantially parallel to the opposed parallel surfaces. In an embodiment of an antenna, the antenna includes a conductor having a pair of opposed lateral surfaces, and a cable guide arranged inside the conductor and oriented in a direction substantially parallel to that of the opposed parallel surfaces.

18 Claims, 4 Drawing Sheets

TRANSMISSION LINE CONDUCTOR FOR LOG-PERIODIC DIPOLE ARRAY

The present application is a DIV application of U.S. patent application Ser. No. 10/022,759, filed Dec. 13, 2001, now U.S. Pat. No. 6,677,912.

BACKGROUND OF THE INVENTION

1. Field of the Invention

This invention relates to conductive elements for antennas and, more particularly, to a conductive element allowing improved log-periodic dipole array performance.

2. Description of the Related Art

The following descriptions and examples are not admitted to be prior art by virtue of their inclusion within this section.

Log-periodic dipole array (LPDA) antennas are popular broadband antennas for many applications. An LPDA includes an array of electric dipoles having varying length extending outward from a pair of feed conductors. The pairs of elements are arranged from shortest to longest, with both the element length and the spacing between elements varying logarithmically along the antenna. The LPDA is a type of "quasi-frequency-independent" antenna, having relatively constant radiation pattern and input impedance characteristics over a frequency range extending (approximately) from the half-wavelength frequency of the longest dipole to the half-wavelength frequency of the shortest dipole.

The LPDA is typically oriented during use such that the end with the shortest elements is pointed in the desired direction of transmission or reception. Furthermore, the antenna is generally designed to be fed at the end with the short elements. These practices help to avoid pattern distortions by reducing effects such as shadowing, reflections, and excitation of harmonics in the longer elements. The feeding at the front end (the short-element end) of the antenna is typically accomplished by running a coaxial feed line along the interior of one of the conductors to which the antenna elements are connected. In this way, the feed signal can be brought to the front of the antenna, while the connector to the signal source (or receiver) is at the back (the long-element end). In such an arrangement, the inner conductor of the coaxial feed line is kept isolated from the outside of the conductor through which it is fed, and connected to the other conductor, so that the feed voltage is applied across the two conductors. An illustration of this connection at the front of an LPDA is shown in FIG. 1. In this embodiment, feed line inner conductor 16 is isolated from outer conductor 12 by insulator 18. Inner conductor 16 is connected to conductor 14, which is in this case a solid conductor, so that the feed voltage may be dropped between conductor 14 and conductor 12.

In addition to the mechanical convenience generally realized by having the connector at the back of the antenna, and the reduced possibility of pattern interference from having a connector at the front, the arrangement of FIG. 1 provides the advantage of creating an intrinsic balancing mechanism for the antenna. Connection of a typical single-ended, or unbalanced, feed voltage directly across the front end of the antenna, on the other hand, would require use of an additional balancing transformer. In the particular configuration of FIG. 1, the inner surface of conductor 12 functions as the shield of the coaxial feed line. At the end of the conductor, currents induced in the shield may flow back along the outer surface of conductor 12, resulting in a balanced line. (The antenna currents described herein are AC currents and exist only within a few skin depths of the surface of a conductor. AC current can therefore flow in one direction on one surface of a conductor, such as the inner wall of a tube, and in the other direction on another surface of the conductor, such as the outer wall of the tube. The tube wall is so many skin depths thick that the current on the inner wall doesn't "see" the current on the outer wall.) In some practical LPDA configurations, as discussed further below, the feed conductor is separate from the coaxial feed line shield. In such cases the feed line shield is connected to the conductor to allow the return current path.

In order for the antenna's radiation to be directed "forward" (out from the short-element end), even though it is being fed "backwards" (feed signal starting at short-element end and traveling along transmission line toward long-element end), the phasing of the feed signals seen by each dipole must be such that the radiation adds constructively in the reverse direction to that of the feed signal travel. In particular, alternating pairs of elements must be fed by signals 180° out of phase. Referring to FIG. 1, elements 20*a* and 20*b* constitute the first, and smallest, pair of dipole elements in the LPDA, while elements 22*a* and 22*b* constitute the next pair. Several other element pairs not shown in FIG. 1 would typically be present, extending from points further along the feed conductors. It can be seen that for the first element pair in FIG. 1, the upper element is connected to conductor 14, and the lower element to conductor 12. For the second element pair, the opposite is true: the upper element is connected to conductor 12, and the lower to conductor 14. The feed voltage applied between the upper and lower halves of the first dipole, therefore, is of opposite polarity to the feed voltage applied between the corresponding halves of the second dipole. The third dipole (not shown) in such an arrangement would be connected in the manner of the first, the fourth in the manner of the second, and so on.

Because each feed conductor in the LPDA of FIG. 1 has elements extending from it in two directions, the two feed conductors cannot be arranged side-by-side in the plane of the elements. Instead, feed conductors 12 and 14 are spaced apart within a plane perpendicular to that of the elements. This arrangement leads to an offset in position between the halves of the dipole, as represented by distance "D" between the positions of elements 20*a* and 20*b* in FIG. 1. Ideal dipoles have both of their elements arranged along the same line, and the offset of FIG. 1 can give rise to cross-polarization and pattern distortion. It would therefore be desirable to minimize this offset by, for example, minimizing the spacing between conductors 12 and 14.

The spacing between the conductors is constrained by other design considerations, however. In fact, the conductor spacing affects the antenna performance more directly and strongly in other ways than through the cross-polarization distortion described above. As alluded to above and shown in FIG. 1, the combination of conductors 12 and 14, and the currents flowing on their outer surfaces, give rise to an overall transmission line 24 feeding the LPDA. The characteristic impedance of this transmission line should be designed such that the input impedance of the antenna matches that of the entire system (including transmitter or receiver) to the extent possible. Furthermore, proper operation of the antenna itself may require the characteristic impedance to have a particular level (or at least lie within a particular range). The characteristic impedance of a transmission line such as line 24 depends upon factors including the spacing between conductors and the shape of each individual conductor. Some "feel" for this can be obtained by considering an approximate expression for the characteristic impedance $Z_0$ of an ideal two-wire transmission line:

$$Z_0 \approx 120 \ln(2D/d),$$

where D is the conductor-to-conductor spacing and d is the diameter of each of the conductors. In order to reduce the spacing between conductors of the two-wire line without changing the characteristic impedance of the line, therefore, the diameters of the conductors must also be reduced.

The above expression generally does not apply directly to the feed transmission line of an LPDA, however. For example, LPDA conductors are typically not cylindrical as shown in FIG. 1, because such conductors would require brazing or soldering of the elements to the conductors. For improved manufacturability, it is desirable to have conductors with flat surfaces to allow the use of screws to fasten the elements to the conductors. A typical design uses a rectangular tube for a conductor, where the tube has holes formed in a pair of facing walls to allow the elements to be screwed on. A coaxial feed line is then fed through the portion of the tube not blocked by the screws extending through the tube. Feeding the line through in the presence of the screws can be difficult, and reducing the size of the tube (in analogy to reducing the diameter of the conductor in the two-wire line discussed above) would make this assembly more difficult still. Another possible approach to reducing the size of a conductor would be to reduce the diameter of the feed line. For example, various diameters of coaxial cable having a given characteristic impedance are available. Reducing the feed line diameter is not desirable, however, in that a reduced-diameter line has reduced power-handling capability and greater dissipation loss.

It would therefore be desirable to develop a conductor having a shape which allows for close spacing of conductors in an LPDA, while appropriate characteristic impedances are maintained. The desired conductor design should not compromise the performance (such as power-handling capability) or ease of fabrication of the conductor or systems built using it.

SUMMARY OF THE INVENTION

The problems described above may be addressed at least in part by a conductive member described herein. In an embodiment, the conductive member may include a conductor having a pair of opposed parallel surfaces and a cable guide arranged inside the conductor. The conductor may be a monolithic conductor. The cable guide may be oriented in a direction substantially parallel to that of the opposed parallel surfaces, and may be adapted to maintain an insulated wire or cable arranged within the guide in a straight orientation within the conductive member. "In a straight orientation" as used herein may refer to maintaining an inner conductor of such an insulated wire or cable within some fixed distance of a fixed lateral position within the guide. In an embodiment, the fixed distance may be a millimeter or less. The conductor and cable guide may take various forms. In an embodiment, for example, the conductor could include a first conductive tube, and the cable guide could include a smaller tube attached to an inner wall of the first tube. Alternatively, the conductor could include a conductive bar, and the cable guide could include an opening formed within the bar.

In another embodiment of a conductive member described herein, the member may include a conductor having a pair of opposed parallel surfaces and a convex surface connecting respective first ends of the pair of opposed parallel surfaces to one another. The member may in some cases include a concave surface arranged opposite the convex surface of the conductor, where the concave surface connects respective other ends of the pair of opposed parallel surfaces. The member may include an opening formed within the conductor in a direction substantially parallel to that of the opposed parallel surfaces, where the opening is adapted to maintain an insulated wire or cable in a straight orientation within the member. In an embodiment, the opening is formed within a portion of the conductor bounded by the convex surface, and a shape of the convex surface follows a shape of a portion of the opening. Each of the opposed parallel surfaces may extend along the length of the conductor, and have sufficient width, along a direction perpendicular to the length of the conductor, to provide a flat mounting surface for a radiating element of an LPDA antenna. A set of holes may be formed through at least one of the opposed parallel surfaces, and the holes may further be spaced apart with a logarithmically increasing spacing between them, to allow attachment of radiating elements of an LPDA antenna. In another embodiment, the conductor may include first and second portions joined together, where each of the portions includes a part of the opening.

In an embodiment of an antenna described herein, the antenna includes a monolithic first conductor having a pair of opposed lateral surfaces, and a cable guide arranged inside the first conductor and oriented in a direction substantially parallel to that of the opposed parallel surfaces. The antenna further includes a length of insulated wire or cable arranged within the guide, where the wire or cable is maintained by the guide in a straight orientation along and within the conductor, and at least one conductive antenna element attached to one of the opposed parallel surfaces of the first conductor. In an embodiment, the antenna element is oriented in a direction substantially perpendicular to that of the first conductor. The length of insulated wire may include an inner conductor surrounded by a dielectric sleeve. In some embodiments, the length of insulated wire may further include an outer conductor surrounding the dielectric sleeve. The first conductor and cable guide may take various forms, as described above with respect to the conductive member described herein.

The antenna may further include a second conductor having a pair of opposed parallel surfaces, where an inner conductor of the length of insulated wire or cable is electrically coupled to an end of the second conductor. At least one conductive antenna element may be attached to one of the opposed parallel surfaces of the second conductor. In an embodiment, the first and second conductors may include first and second convex surfaces, wherein the first convex surface bridges between first ends of the pair of opposed parallel surfaces of the first conductor, and the second convex surface bridges between first ends of the pair of opposed parallel surfaces of the second conductor. The first and second conductors in such an embodiment may be arranged such that their respective opposed parallel surfaces are aligned, and the first and second convex surfaces face away from each other. In a further embodiment, the first and second conductors may include first and second concave surfaces, where the first concave surface bridges between other ends of the pair of opposed parallel surfaces of the first conductor, and the second concave surface bridges between other ends of the pair of opposed parallel surfaces of the second conductor. The first and second conductors in such an embodiment may be arranged such that the first and second concave surfaces face each other.

In another embodiment of an antenna described herein, the antenna includes a conductor having a pair of opposed parallel surfaces, a convex surface connecting respective first ends of the pair of opposed parallel surfaces to one another, and an opening formed within the conductor in a direction substantially parallel to that of the opposed parallel surfaces. The antenna may also include a length of insulated wire or cable arranged within the opening, and at least one conductive antenna element attached to one of the opposed parallel surfaces of the conductor. The antenna element may be oriented in a direction substantially perpendicular to that of the conductor.

An embodiment of a method described herein for forming a conductive member includes forming a cable guide arranged inside a monolithic conductor having opposed parallel surfaces, where the cable guide is oriented in a direction substantially parallel to the opposed parallel surfaces. The cable guide may be adapted to maintain an insulated wire or cable in a straight orientation within the conductive member. In an embodiment for which the conductor includes a first conductive tube, the forming of the cable guide may include attaching a second tube to an interior wall of the first tube. The method may further include forming the conductor. In an embodiment, forming the conductor may include forming a conductive bar, and forming the cable guide may include forming an opening within the bar. Forming the conductive bar and forming the opening in such an embodiment may be done in various ways, including extruding metal, drawing metal, and casting metal. The method may further include forming a set of holes through at least one of the opposed parallel surfaces of the conductor. Forming the holes may be done using various techniques, such as casting metal or machining the conductor. In another embodiment of a method, an opening is formed within a conductor having opposed parallel surfaces and a convex surface connecting respective first ends of the pair of opposed parallel surfaces to one another. The opening may be formed within a portion of the conductor bounded by the convex surface, and a shape of the convex surface may follow a shape of a portion of the opening.

The conductive members described herein are believed to provide extreme control of the shape of a member carrying a feed line. For example, because the cable guide fixes the position of the feed line, there is no constraint of allowing extra room to feed the line through the member in the presence of obstructions such as antenna element screws. When a pair of the conductive members is used to form a balanced transmission line, this control may allow the conductor shape to be tailored for a high impedance of the transmission line, even when the conductors are spaced close together. Such close spacing between conductors is desirable for reducing cross-polarization distortion in LPDA antennas. The control of conductor shape may also allow a high transmission line impedance to be obtained even when a large-diameter feed line is used. The power-handling capability of the member (and system employing the member) may therefore be maintained or increased.

BRIEF DESCRIPTION OF THE DRAWINGS

Other objects and advantages of the invention will become apparent upon reading the following detailed description and upon reference to the accompanying drawings in which.

Figure 1:
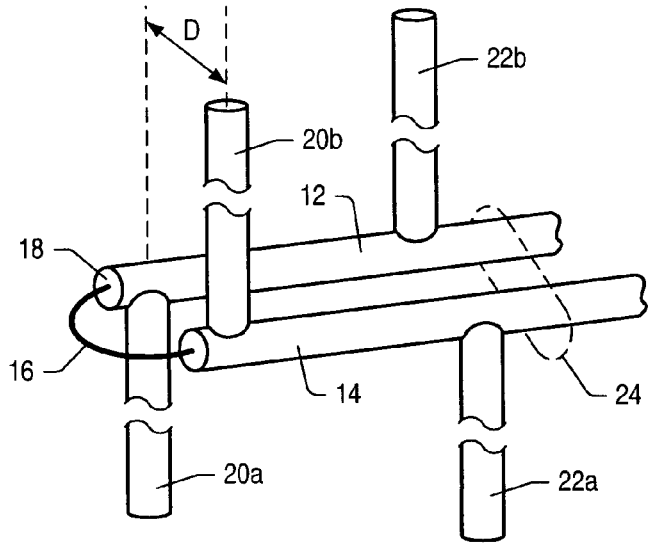
FIG. 1 illustrates the general feed configuration at the front end of an exemplary LPDA antenna.

While the invention may be modified and have alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Figure 2A:
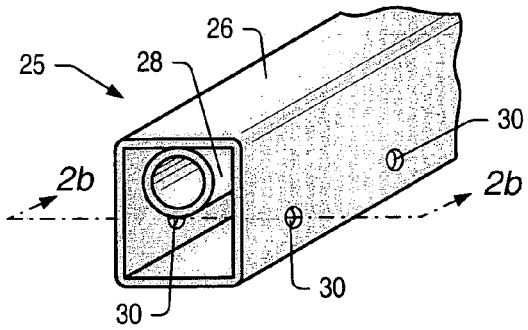
FIG. 2*a* is a perspective view showing one end of an embodiment of a conductive member as described herein.
Figure 2B:
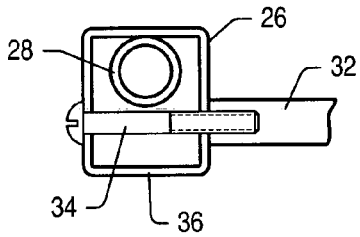
FIG. 2*b* is a cross-sectional view along cut 2*b*–2*b* of the conductive member of FIG. 2*a*, further showing an antenna element attached to the conductive member using a screw.

Turning to the drawings, a perspective view of one end of a conductive member as described herein is shown in FIG. 2*a*. Conductive member 25 includes a conductor 26 and cable guide 28. In the embodiment of FIG. 2*a*, conductor 26 is a conductive tube having a rectangular cross-section. "Conductive" as used herein refers to electrical conductivity, though conductive elements described may be thermally conductive as well. In an embodiment, conductor 26 is made from aluminum. Other conductive materials may also be suitable, however, such as copper or other metals or metal alloys. Multiple conductor layers may be included in conductor 26, and various surface coatings or finishes may be used. It is noted that conductor 26 does not need to have a rectangular cross-section as shown in FIG. 2*b*, although a shape having a pair of opposed parallel surfaces is currently believed to be preferable. Tube 26 could have a parallelogram or trapezoidal shape, for example, though availability of such shapes is believed to be limited. Cable guide 28 is a second tube having circular cross-section in the embodiment of FIG. 2*a*. The outer wall at the top of guide 28 is attached to the inner wall at the top of conductor 26. Cable guide 28 is oriented in a direction substantially parallel to that of conductor 26, so that the guide is in a direction substantially parallel to any of the surfaces of conductor 26 which run the length of conductor. In the embodiment of FIG. 2*a*, the main constraint on the orientation of the cable guide is that it stay within conductor 26, and out of the way of any screws 24, as shown in FIG. 2*b*, throughout the length of conductor 26. The amount of deviation from a purely parallel path therefore depends on the length of conductor 26.

The materials used for guide 28 and the nature of the connection between conductor 26 and guide 28 may vary, depending on the particular way that conductive member 25 is to be used. If member 25 is to be used as one conductor of a balanced two-conductor transmission line such as line 24 of FIG. 1, it is important that there be a shield surrounding the insulated wire or cable placed within cable guide 28, and that currents induced in the shield have a path by which to flow back along the outer surface of conductor 26. The shield surrounding the wire or cable should have a uniform shape throughout the length of the conductor, and is preferably immediately surrounding and in contact with the insulation, so that predictable transmission characteristics for the insulated wire or cable are obtained. If cable guide 28 is a conductive tube, formed from similar materials as discussed above for conductor 26, then the cable guide itself may function as the shield, in a manner similar to that of conductor 12 in the configuration of FIG. 1. In such an embodiment, cable guide 28 must be electrically connected to conductor 26, to provide the return current path described above. This connection may be conveniently accomplished by attaching guide 28 to conductor 26 using a soldering or brazing technique such that a good (low-resistance) electrical connection is formed between the guide and the conductor. Other attachment techniques, including conductive cements, clamps, fasteners or combinations of these may also be suitable. If the attachment method does not form a good electrical contact, separate electrical connection between the guide and conductor at each end of the member could also be made.

In embodiments for which cable guide 28 functions as the shield for an insulated wire or cable, the wire or cable is preferably maintained in a position at the axial center of cable guide 28, so that a high-quality coaxial line may be formed. The wire or cable may therefore be maintained by the guide in a straight orientation within the conductive member. By fitting relatively snugly into the guide, the wire or cable is preferably maintained at a position within about a millimeter of a fixed lateral position within the guide (e.g., the axial center of the guide), throughout the length of conductor 26. The wire or cable is still more preferably maintained at a position within about 0.25 millimeters of a fixed lateral position within the guide (in fact, tolerances may be considerably tighter than this in some embodiments). Even in embodiments for which guide 28 does not function as the shield for an insulated wire or cable, the guide preferably maintains the cable in a straight orientation as described above. This may help to allow a reduced circumference of conductor 26, as discussed further below.

If, on the other hand, cable guide 28 is formed from a non-conductive material and the conductive member is to be used as part of a balanced transmission line, the coaxial feed line to be held by guide 28 must include its own shield. This shield would further need to be connected to conductor 26 at each end of conductive member 25. In such an embodiment, the electrical conductivity of the attachment of guide 28 to conductor 26 would not be important. Furthermore, cable guide 28 would not have to continuously surround the feed line in an embodiment for which the feed line had its own shield. For example, the guide could have a "C"-shaped cross-section rather than a circular cross-section, as long as the feed line is sufficiently surrounded so as to be held in position. On the other hand, even for embodiments in which the cable guide is configured such that it could serve as the feed line shield, it may be desirable in some cases to retain the feed line's own shield as well. This may allow, for example, extension of the coaxial feed line out of the conductive member to facilitate formation of or connection to a different system component. Furthermore, the shield of a coaxial feed line may be made from a material, such as silver, having a higher conductivity than the material from which the cable guide is formed.

In the embodiment of FIG. 2*a*, holes 30 are formed in opposed parallel walls of conductor 26. Each hole in one wall of the tube is aligned with a hole in the opposing wall, and the holes are positioned below the bottom of cable guide 28. As shown in FIG. 2*b*, which shows a cross-section along cut 2*b*–2*b* of FIG. 2*a*, these pairs of holes can be used for mounting of an antenna element 32 using a screw 34. Use of cable guide 28 in conductor 26 is believed to allow conductive member 25 to be smaller overall, without sacrificing performance or ease of fabrication. In the absence of cable guide 28, formation of an LPDA antenna using conductive member 25 would involve threading a coaxial cable through the portion of conductor 26 not blocked by screws 34. Depending on the frequency range covered by the antenna, a conductive member within an LPDA can be several feet long (even several meters long). Because coaxial cable typically bends or bows to some extent, feeding the cable through a long conductor partially blocked by screws can be difficult and time-consuming, even when conductor 26 is made considerably larger with respect to the cable diameter than is shown in FIG. 2*b*. Inclusion of cable guide 28 in conductive member 25 is therefore believed to allow a reduction in the diameter of conductor 26 as compared to the conductor in a conventional conductive member for an LPDA, without having a negative impact on the ease of manufacture of the antenna. In fact, in embodiments for which guide 28 is a conductive tube, and the cable used is a coaxial cable having TEFLON® insulation and its shield removed, threading of the cable through the conductive member has been found to be substantially easier as compared to manufacture using a conventional conductive member.

In addition to possible improvements in manufacturability, the reduction in conductor diameter made possible by the configuration of FIG. 2*a* is believed to increase the characteristic impedance of a balanced transmission line formed using a pair of the conductive members. As noted above, the characteristic impedance of a two-wire balanced line depends on both the spacing between the wires and the diameter of the individual wires. Although the formula given above cannot be accurately applied to a transmission line formed using a pair of conductive members such as that of FIG. 2*a*, effects on the characteristic impedance of such a line can be estimated by considering the capacitance between the two conductive members. In general, a transmission line characteristic impedance can be described as the square root of the quotient of its inductance per unit length and its capacitance per unit length. To maintain or increase the characteristic impedance of a balanced transmission line when reducing the spacing between its two conductors, therefore, the capacitance per unit length between the conductors should be minimized. "Capacitance" and "inductance" as used herein refer also to capacitance per unit length and inductance per unit length.

Figure 9A:
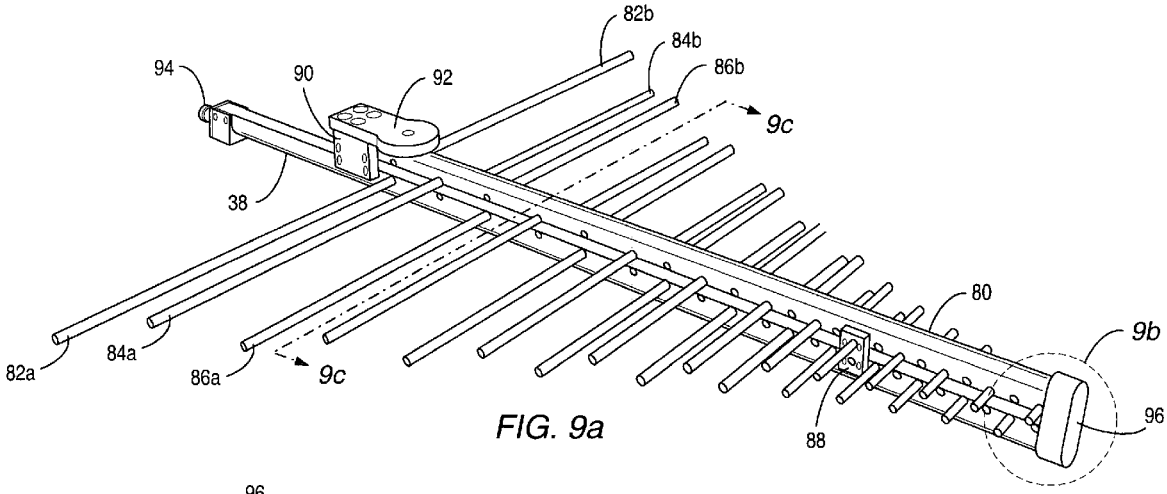
FIG. 9*a* is a perspective view of an LPDA antenna formed using conductive members similar to that of FIG. 8*a;*
Figure 9B:
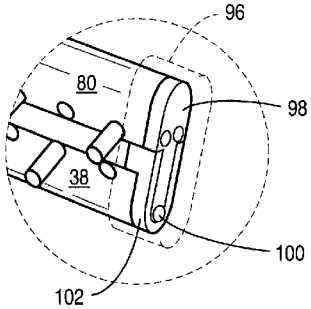
FIG. 9*b* is a perspective view, within region 9*b* of FIG. 9*a*, of the front end of the antenna with the end cap removed.
Figure 9C:
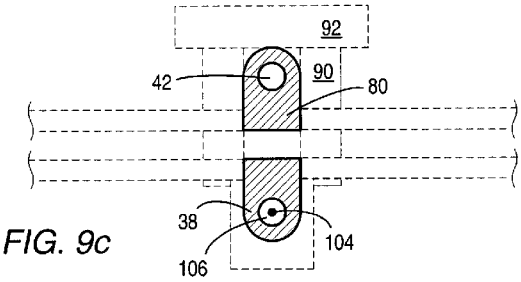
FIG. 9*c* is a cross-sectional view along cut 9*c*–9*c* of the antenna of FIG. 9*a*.

When configured as a balanced transmission line, a pair of conductive members such as that of FIG. 2*b* is preferably oriented such that "bottom" surfaces 36 (with respect to the orientation of FIG. 2*b*) of each member face each other. An example of this orientation (using a different embodiment of the conductive member) is shown in FIGS. 9*a*, 9*b* and 9*c*. This orientation is desirable when forming an LPDA because it allows the smallest offset between dipole elements. Many of the conductive member shapes described herein are rather irregular, such that the capacitance between members is difficult or impossible to determine analytically. The effect of the shape on capacitance can be estimated, however, using various general considerations. For example, it can be seen by envisioning a parallel-plate capacitor between the two conductive members that reducing the "footprint" of each member as "seen" by the other member, or reducing the area of surfaces 36, should reduce the capacitance. In addition, because the AC currents on the transmission line are confined near the surface of each conductive member, reduction of the circumference of each member should reduce the surface area and thereby the capacitance. Because the configuration of FIG. 2*a* allows conductor 26 to have a smaller circumference than would be used in the absence of cable guide 28, this configuration is believed to reduce the capacitance of conductive member 25 as compared to a conventional conductive member. The characteristic impedance of a balanced transmission line formed using a pair of conductive members 25 is therefore believed to be higher, allowing a smaller spacing between the conductive members and a lower offset between LPDA dipole elements. Because tubes tend to be formed in certain standard sizes, smaller tubes are likely to have smaller facing surface areas, also contributing to the reduced capacitance.

Alternative embodiments of a conductive member as described herein are shown in FIGS. 3–7. Conductive member 38 of FIG. 3*a* includes conductive bar 40. An opening 42 is formed within conductive bar 40 and runs along its length, so that opening 42 may serve as a cable guide. In an embodiment, conductive bar 40 is made from aluminum, but other conductive materials may also be suitable. In the embodiment of FIG. 3*a*, conductive bar 40 includes opposed parallel surfaces 44*a* and 44*b*, and a convex surface 46 which connects the upper ends of surfaces 44*a* and 44*b*. Cable guide 42 is oriented in a direction parallel to that of conductive bar 40, or to that of surfaces running along the length of bar 40, such as opposed parallel surfaces 44*a* and 44*b*. As noted above with respect to cable guide 28 of FIG. 2*a*, the amount by which the cable guide can deviate from being perfectly parallel depends on the length of the conductive member. The opening must clearly be formed straight enough that opening 42 stays within bar 46 throughout its length. Furthermore, a sufficient metal thickness must remain between opening 42 and the outer surface of bar 40 along its entire length that currents induced on the wall of opening 42 do not "see" currents on the outer surface of bar 40. For embodiments in which conductive member 38 is formed by extrusion, discussed further below, accurate orientation of the opening is believed to present little difficulty.

Figure 3A:
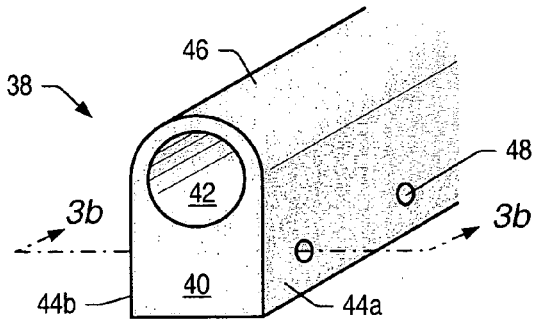
FIG. 3*a* is a perspective view showing one end of another embodiment of a conductive member as described herein.
Figure 3B:
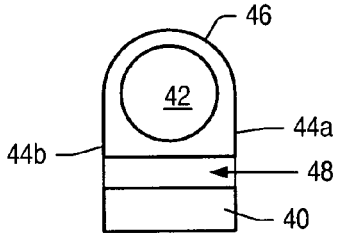
FIG. 3*b* is a cross-sectional view along cut 3*b*–3*b* of the conductive member of FIG. 3*a;*

Because cable guide 42 is an opening within conductive bar 46, the wall of the opening is conductive and may function as the shield of an insulated wire or cable placed within the opening. Such a wire or cable could advantageously be made from a commercial coaxial cable with the outer insulation and shield removed. The shield may also be left on such a cable in some embodiments, however, as discussed above in the description of FIG. 2. Like cable guide 28 and any other cable guides described herein opening 42 is adapted to maintain an insulated wire or cable in a straight orientation, in the manner discussed above with respect to cable guide 28. In the embodiment of FIG. 3*a*, holes 48 are formed through conductive bar 46, passing through surfaces 44*a* and 44*b*. As shown in the cross-sectional view of FIG. 3*b*, each hole 48 provides a channel through which an antenna element (not shown) can be attached with a screw in the manner shown in FIG. 2*b*. The shape of conductive member 38 is believed to allow relatively close spacing of a pair of such conductive members used to form a transmission line, while maintaining a suitably high characteristic impedance of the line. By including a convex surface that follows the shape of the opening at the top of the conductive bar, and having a width only slightly greater than the diameter of the opening, the conductive bar presents a relatively small footprint and small circumference. This should reduce capacitance of a balanced transmission line formed with a pair of the conductive members, as discussed above with respect to the conductive member of FIG. 2, and in turn help to maintain a higher characteristic impedance of the transmission line.

Figure 4A:
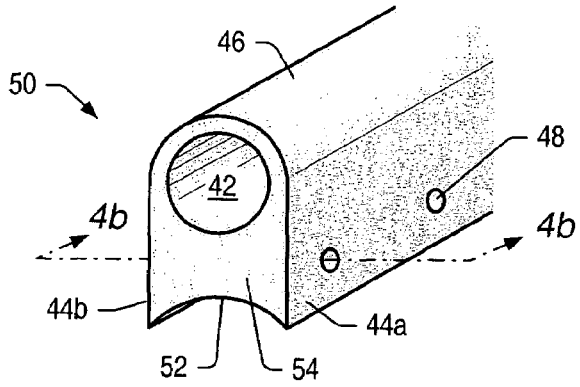
FIG. 4*a* is a perspective view showing one end of a conductive member similar to that shown in FIG. 3*a*, but with a concave lower surface.
Figure 4B:
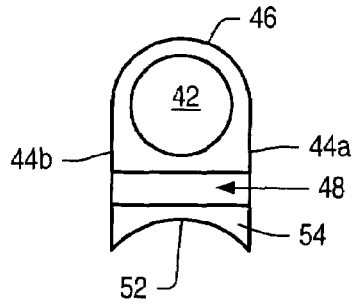
FIG. 4*b* is a cross-sectional view along cut 4*b*–4*b* of the conductive member of FIG. 4*a;*

In another alternative embodiment, conductive member 50 is shown in FIGS. 4*a* and 4*b*. The embodiment of FIG. 4*a* is similar to that of FIG. 3*a*, but conductive bar 54 includes a concave surface 52 at the bottom. While convex surface 46 connects upper ends of parallel surfaces 44*a* and 44*b*, concave surface 52 connects the lower ends of the parallel surfaces. For a given spacing between conductive members in a transmission line configuration, conductive member 50 is believed to result in a lower transmission line capacitance, and therefore a higher impedance than for a transmission line formed using conductive member 38. Because the concave surfaces 52 are oriented to face one another in a transmission line configuration, use of concave rather than flat surfaces effectively "pulls apart" the plates of the parallel plate capacitor formed by the facing surfaces, lowering the capacitance.

Figure 5A:
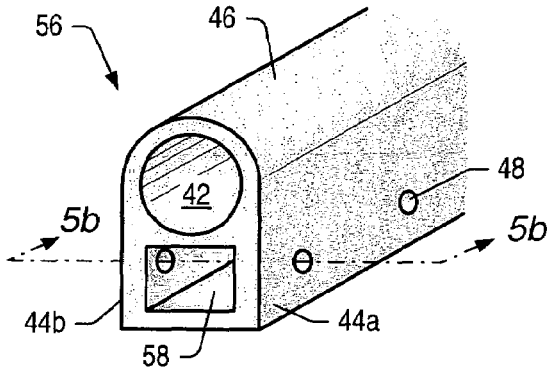
FIG. 5*a* is a perspective view showing one end of a conductive member similar to that shown in FIG. 3*a*, but with an additional opening.
Figure 5B:
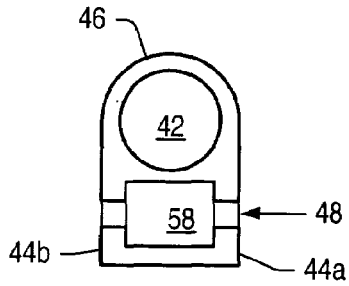
FIG. 5*b* is a cross-sectional view along cut 5*b*–5*b* of the conductive member of FIG. 5*a;*
Figure 6A:
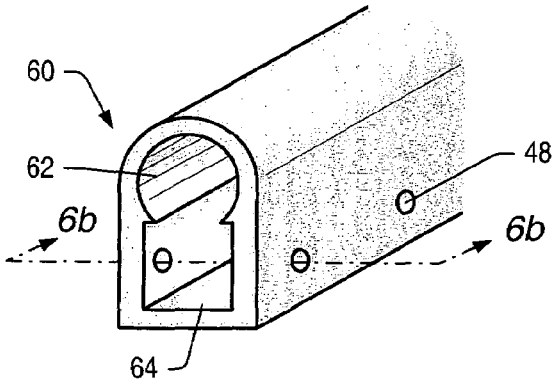
FIG. 6*a* is a perspective view showing one end of a conductive member similar to that shown in FIG. 5*a*, but with the openings merged together.
Figure 6B:
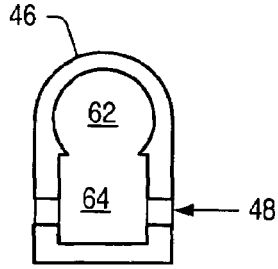
FIG. 6*b* is a cross-sectional view along cut 6*b*–6*b* of the conductive member of FIG. 6*a;*

Conductive member 56 of FIGS. 5*a* and 5*b* is similar to conductive member 38 of FIG. 3, except that an additional opening 58 is formed along the length of the conductive bar. Although this embodiment is not believed to provide substantially different performance as compared to conductive member 38 of FIG. 3, the additional opening may significantly reduce the weight of the conductive member. Particularly in the event of fabrication of large LPDA antennas, such weight considerations may be important. As illustrated by the embodiment of FIGS. 6*a* and 6*b*, the cable guide may not completely encircle the cable it carries in some embodiments. Conductive member 60 is similar to conductive member 56 of FIG. 5*a* except that the cable guide opening and the additional opening are merged together. Cable guide opening 62 of FIG. 6*a* retains sufficient curvature to keep a cable in position and not let the cable move into additional opening 64. It is important to note that the insulated wire or cable used with conductive member 60 must have its own surrounding conductive shield, since the inner wall of opening 62 cannot completely surround a cable.

Figure 7:
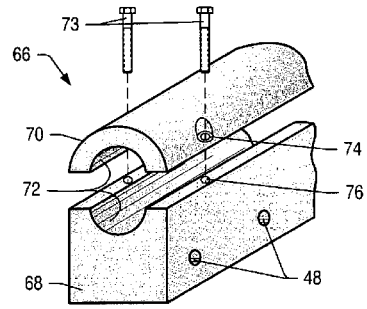
FIG. 7 is a perspective view showing one end of a conductive member similar to that shown in FIG. 3*a*, but formed using a two-piece construction.

In an embodiment, the conductive members shown in FIGS. 3–6 are formed using extrusion of aluminum. Element mounting holes such as holes 48 may then be formed by machining the extruded members. Other techniques, such as drawing or casting, could also be used, however. A casting process could be used in some embodiments to form a conductive member with element mounting holes using a single casting. An alternative approach, in which machining is used to form the conductive member is illustrated by the two-piece conductive member of FIG. 7. In the embodiment of FIG. 7, conductive member 66 includes a lower conductor portion 68 and upper conductor portion 70. Each portion includes a groove 72, where the grooves are adapted to align to form an opening such as opening 42 of FIG. 3 when the upper and lower portions are connected together. In this embodiment, the portions are connected together using screws 73 passing through holes 74 in the upper portion and into holes 76 in the lower portion. Such screws and holes may be formed at intervals along the length of member 66, or other fasteners could be used instead. Although the arrangement of FIG. 7 may not represent a particularly simple or economical fabrication method, it does allow for fabrication using machining. Such a technique may be desirable in some embodiments for prototype fabrication and testing, for example. Conductive member 66 of FIG. 7 is somewhat similar to member 38 of FIG. 3*a*, and a groove could be formed at the bottom of portion 68 to result in a structure somewhat similar to member 50 of FIG. 4*a*. Use of such a machining technique to form structures having multiple openings, however, such as those shown in FIGS. 5*a* and 6*a*, is more involved in that at least three separate portions would be needed. The two-piece construction of the conductor in FIG. 7 is in contrast to the monolithic, or one-piece, construction of conductors 26 and 46 in FIGS. 2–6.

The conductive member structures described with reference to FIGS. 1–7 are merely exemplary, and many variations are possible. For example, although aluminum, and particularly 6000 and 7000 series alloys, is believed to be a desirable conductor material in terms of conductivity and weight, other conductors such as copper and its alloys may also be suitable, as noted above. Although the conductive members shown include holes suitable for mounting of antenna elements, such holes may not be present in every embodiment. For example, elements could be attached by means other than screws in some cases. When holes are used for antenna element attachment, the precise attachment configuration may vary from that of FIG. 2*b*, in which a screw is used to attach an element having a threaded hole. A portion of threaded rod could extend from the element, for example, and be secured to the conductor with a nut. Or, in an embodiment in which the element holes are formed through a solid bar, threaded holes might be formed in the bar in some embodiments.

Figure 8A:
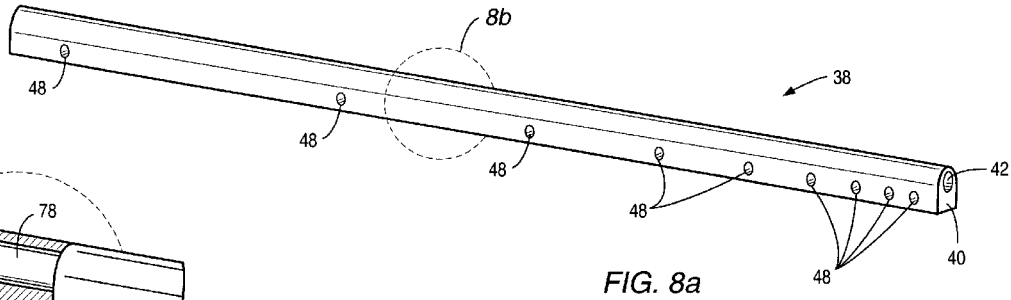
FIG. 8*a* is a perspective view of a conductive member similar to that of FIG. 3*a;*
Figure 8B:
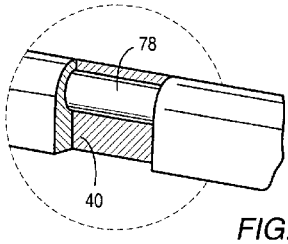
FIG. 8*b* shows a cutaway view of the conductive member within region 8*b* of FIG. 8*a;*

Use of a conductive member such as those described in FIGS. 1–7 in an LPDA is illustrated by FIGS. 8 and 9. An extended length of conductive member 38 of FIG. 3 is shown in FIG. 8*a*. It can be seen that holes 48 have a logarithmically-increasing spacing between them along the length of conductor 40. This hole spacing may allow antenna elements to be attached to the conductive member with a logarithmic spacing in order to form an LPDA. A cutaway view of the conductive member in region 8*b* is shown in FIG. 8*b*. In the embodiment of FIG. 8*b*, an insulated wire 78 is arranged within opening 42 of conductor 40. Insulated wire 78 may be formed from a piece of coaxial cable with its outer insulation and outer shield removed, such that the outer surface of insulated wire 78 is an insulating surface. In such an embodiment, the inner surface of opening 42 in conductor 40 forms an outer shield around insulated wire 78. Such an insulated wire could of course be formed in ways other than by modification of commercially-available coaxial cable, although such modification may be convenient in some cases. For example, a separate inner conductor and insulating tube could be combined to form insulated wire 78. In another embodiment, insulated wire 78 could also include an outer shield, so that the outer surface of insulated wire 78 is a conductive surface. As noted above, retaining of a separate outer shield may be advantageous in some applications, even though the outer shield could be formed from the inner surface of opening 42. In still another embodiment, additional insulation could be retained between an outer shield of insulated wire 78 and the inner surface of opening 42. For example, a coaxial cable complete with outer insulation could be used for insulated wire 78. In such an embodiment, the outer shield of the coaxial cable would have to be connected to conductor 40 at each end, however.

An exemplary embodiment of an LPDA antenna formed using conductive member 38 of FIG. 8*a* is shown in FIG. 9*a*. Conductive member 38 is combined with conductive member 80 to form the overall transmission line feeding the LPDA. These conductive members support the antenna elements, and may be together referred to as the "boom" of the antenna. Conductive member 80 is similar in shape to conductive member 38, but member 80 does not need to carry a feed line, and therefore does not need to have an opening such as opening 42 of member 38. Such an opening may be included in member 80 in some cases, however. Including the opening may simplify fabrication of the conductive members and/or reduce the weight of the antenna. Conductive member 80 is shorter than member 38 in the embodiment of FIG. 9*a*, but the relative lengths of the conductive members may vary with the particular design of the antenna. Although the embodiment of FIG. 9 includes conductive members having the shape shown in FIGS. 3 and 8, any other conductive member as described herein may also be used, such as those of FIGS. 2 and 4–7. The spacing between conductive members 38 and 80 may be maintained using insulating spacers such as spacers 88 and 90. In the embodiment of FIG. 9*a*, the spacing between conductive members is held constant along the length of the boom, but in some embodiments this spacing could vary. For example, the antenna may in some cases be formed in a "V" shape, with a slightly larger spacing between members 38 and 80 at the large-element end. Spacer 90 is attached to a tripod mount 92 in the embodiment of FIG. 9*a*.

The antenna elements are connected to the conductive members in a manner similar to that shown in FIG. 1, such that each dipole includes one element attached to each of the conductive members, and the dipoles are fed with alternating polarity. In the embodiment of FIG. 9*a*, for example, elements connected to conductive member 38 include 82*a*, 84*b*, and 86*a*, while those connected to conductive member 80 include 82*b*, 84*a*, and 86*b*. In an embodiment, the elements are made from conductive rod (e.g., circular bar stock), such as aluminum rod, and the longer elements may have larger diameter than the shorter elements. The feed signal is connected at the large-element end using coaxial connector 94. The outer shield of connector 94 is connected to conductive member 38, so that member 38 is preferably at ground potential. The inner conductor of connector 94 is connected to the inner conductor of an insulated wire or cable carried within conductive member 38. This inner conductor is connected to conductive member 80, as illustrated by FIG. 9*b*. FIG. 9*b* is an expanded view of area 9*b* of FIG. 9*a*, where the view of FIG. 9*b* shows the end of the antenna with insulating cap 96 removed. Conductive bridge 98 connects the inner conductor of the insulated line within member 38, soldered to bridge 98 at point 100, to conductive member 80. Insulating spacer 102 isolates the outside of conductive member 38 from the feed voltage on bridge 98 and conductive member 80.

A cross-sectional view of the antenna of FIG. 9*a* along cut 9*c*–9*c* is shown in FIG. 9*c*. It can be seen in this view that conductive members 38 and 80 are oriented such that the "bottom" sides are facing each other. In this way, the vertical spacing between antenna elements, or the dipole "offset," is minimized. In embodiments for which a conductive member with a concave bottom side, such as that shown in FIG. 4, is used, the resultant "pulling apart" of the facing surfaces is believed to provide a lower capacitance and increased characteristic impedance of the overall transmission line, as discussed further in the description of FIG. 4 above. In the embodiment of FIG. 9*c*, conductive member 80 includes an empty opening 42, but this opening is not necessary, as noted above. Conductive member 38, on the other hand, includes inner conductor 104 surrounded by insulator 106.

It will be appreciated by those skilled in the art having the benefit of this disclosure that this invention is believed to provide a conductive member suitable for LPDA formation, a method for forming such a conductive member, and an antenna formed using the conductive member. Further modifications and alternative embodiments of various aspects of the invention will be apparent to those skilled in the art in view of this description. It is intended that the following claims be interpreted to embrace all such modifications and changes and, accordingly, the specification and drawings are to be regarded in an illustrative rather than a restrictive sense.

What is claimed is:

1. An antenna, comprising:

a monolithic first conductor having a pair of opposed parallel surfaces and a cable guide arranged inside the first conductor, wherein the cable guide extends in a continuous manner along an entire length of the first conductor and is either formed within or attached to the first conductor, such that no surface of the cable guide is penetrated by one or more mounting holes formed within the pair of opposed parallel surfaces of the first conductor;

a length of insulated wire or cable arranged within the cable guide, wherein the wire or cable is maintained by the cable guide in a straight orientation along and within the first conductor; and at least one conductive antenna element attached to one of the opposed parallel surfaces of the first conductor via one of the mounting holes.

2. The antenna of claim 1, wherein the antenna element is oriented in a direction substantially perpendicular to that of the first conductor.

3. The antenna of claim 1, wherein the cable guide is adapted to maintain, throughout the length of the conductor, an inner conductor of the insulated wire or cable within about one millimeter of a fixed lateral position within the guide.

4. The antenna of claim 3, wherein the cable guide is adapted to maintain the inner conductor within about 0.25 millimeters of the fixed lateral position.

5. The antenna of claim 1, wherein the length of insulated wire comprises an inner conductor surrounded by a dielectric sleeve.

6. The antenna of claim 5, wherein the length of insulated wire further comprises an outer conductor surrounding the dielectric sleeve.

7. The antenna of claim 1, wherein the first conductor comprises a first conductive tube.

8. The antenna of claim 7, wherein the first conductive tube has a rectangular cross-section.

9. The antenna of claim 7, wherein the cable guide comprises a second tube attached to an inner wall of the first tube.

10. The antenna of claim 1, wherein the first conductor comprises a conductive bar, and the cable guide comprises an opening formed within the bar.

11. The antenna of claim 1, further comprising:

a second conductor having a pair of opposed parallel surfaces, wherein an inner conductor of the length of insulated wire or cable is electrically coupled to an end of the second conductor; and at least one conductive antenna, element attached to one of the opposed parallel surfaces of the second conductor.

12. The antenna of claim 11, wherein the first and second conductors further comprise first and second convex surfaces, wherein the first convex surface bridges between first ends of the pair of opposed parallel surfaces of the first conductor, and the second convex surface bridges between first ends of the pair of opposed parallel surfaces of the second conductor.

13. The antenna of claim 12, wherein the first and second conductors are arranged such that their respective opposed parallel surfaces are aligned, and such that the first and second convex surfaces face away from one another.

14. The antenna of claim 12, wherein the first and second conductors further comprise first and second concave surfaces, wherein the first concave surface bridges between other ends of the pair of opposed parallel surfaces of the first conductor, wherein the second concave surface bridges between other ends of the pair of opposed parallel surfaces of the second conductor, and wherein the first and second conductors are arranged such that the first and second concave surfaces face each other.

15. The antenna of claim 1, wherein the cable guide is adapted to completely surround the insulated wire or cable in directions perpendicular to a longitudinal axis of the cable guide.

16. The antenna of claim 1, wherein the cable guide is adapted to at least partially surround the insulated wire or cable in directions perpendicular to a longitudinal axis of the cable guide while maintaining a physical separation between the insulated wire or cable and screws or other attachment means inserted within the mounting holes.

17. An antenna, comprising:

a conductor having a pair of opposed parallel surfaces, a convex surface connecting respective first ends of the pair of opposed parallel surfaces to one another, and an opening formed within the conductor in a direction substantially parallel to that of the opposed parallel surfaces;

a length of insulated wire or cable arranged within the opening; and at least one conductive antenna element attached to one of the opposed parallel surfaces of the conductor.

18. The antenna of claim 17, wherein the antenna element is oriented in a direction substantially perpendicular to that of the conductor.

* * * * *

UNITED STATES PATENT AND TRADEMARK OFFICE

CERTIFICATE OF CORRECTION

PATENT NO. : 7,030,829 B1
APPLICATION NO. : 10/727410
DATED : April 18, 2006
INVENTOR(S) : McLean It is certified that error appears in the above-identified patent and that said Letters Patent is hereby corrected as shown below:

In the Claims

Col. 14, line 16: please delete "," between "antenna" and "element."

Signed and Sealed this

Nineteenth Day of December, 2006

JON W. DUDAS
*Director of the United States Patent and Trademark Office*